US012601172B2

(12) United States Patent
Safford

(10) Patent No.: US 12,601,172 B2
(45) Date of Patent: Apr. 14, 2026

(54) SYSTEM AND METHOD FOR SECTIONAL CONSTRUCTION ASSEMBLY FOR USE WITH A WOOD MULLION

(71) Applicant: Innovation Glass, LLC, Tivoli, NY (US)

(72) Inventor: Franz Safford, Tivoli, NY (US)

(73) Assignee: Innovation Glass, LLC, Tivoli, NY (US)

( * ) Notice: Subject to any disclaimer, the term of this patent is extended or adjusted under 35 U.S.C. 154(b) by 218 days.

(21) Appl. No.: 18/604,865

(22) Filed: Mar. 14, 2024

(65) Prior Publication Data

US 2025/0263925 A1 Aug. 21, 2025

Related U.S. Application Data

(63) Continuation-in-part of application No. 18/582,962, filed on Feb. 21, 2024, now Pat. No. 12,571,208.

(51) Int. Cl.
*E04B 2/74* (2006.01)

(52) U.S. Cl.
CPC ..... *E04B 2/7435* (2013.01)

(58) Field of Classification Search
CPC .... E04B 2/7433; E04B 2/7435; E04B 2/7437; E04B 2/7438; E04B 2002/7446; E04B 2/90; E06B 3/5427
See application file for complete search history.

(56) References Cited

U.S. PATENT DOCUMENTS

| | | | |
|---|---|---|---|
| 2,345,650 | A | 4/1944 | Attwood |
| 2,901,785 | A | 9/1959 | Hinchliffe et al. |
| 2,996,845 | A | 8/1961 | Cipriani et al. |
| 3,052,330 | A | 9/1962 | Hammit et al. |
| 3,053,353 | A | 9/1962 | Miller |
| 3,176,806 | A | 4/1965 | Ferrell |

(Continued)

FOREIGN PATENT DOCUMENTS

| | | |
|---|---|---|
| CN | 216865635 | 7/2022 |
| DE | 10111246 | 9/2002 |

(Continued)

OTHER PUBLICATIONS

Stabalux Brochure, Apr. 1, 2008.
QuadroClad Facades, 2008.
Halfen Channel, Halfen GmBH, Jun. 2022.

*Primary Examiner* — Rodney Mintz

(74) *Attorney, Agent, or Firm* — Noblitt & Newson, PLLC

(57) ABSTRACT

A construction section for supporting a glass panel and configured to be coupled to a building structure. The construction section may comprise a wood mullion, an upper fitting, and a gravity fitting. The wood mullion may comprise an elongate body, a pair of cutouts in the upper and lower ends, and upper and lower pockets. The elongate body may comprise an exterior face, an upper end, and a lower end. The pair of cutouts in the upper and lower ends may be configured to receive at least a portion of the building structure. The upper and lower pockets may comprise a void area within the elongate body adjacent the exterior face. The upper fitting may be configured to support at least a portion of the glass panel. The gravity fitting may be coupled within the lower pocket and configured to support at least a portion of the glass panel.

20 Claims, 6 Drawing Sheets

(56) References Cited

U.S. PATENT DOCUMENTS

| | | | | |
|---|---|---|---|---|
| 3,266,209 | A | 8/1966 | Jules | |
| 3,266,210 | A | 8/1966 | Grossman | |
| 3,321,880 | A | 5/1967 | Ferrell et al. | |
| 3,478,480 | A | 11/1969 | Swenson | |
| 3,548,558 | A | 12/1970 | Grossman | |
| 3,561,182 | A | 2/1971 | Madl, Jr. | |
| 3,813,120 | A | 5/1974 | Kelly | |
| 3,900,996 | A | 8/1975 | Yohe | |
| 3,938,297 | A | 2/1976 | Sato et al. | |
| 4,031,680 | A | 6/1977 | Stoakes | |
| 4,073,113 | A | 2/1978 | Oudot et al. | |
| 4,469,198 | A | 9/1984 | Crump | |
| 4,500,572 | A | 2/1985 | Francis | |
| 4,560,130 | A | 12/1985 | Schwartz | |
| 4,568,050 | A | 2/1986 | Radoy et al. | |
| 4,680,905 | A | 7/1987 | Rockar | |
| 4,784,552 | A | 11/1988 | Rebentisch | |
| 4,873,805 | A | 10/1989 | Ting | |
| 4,873,806 | A | 10/1989 | Jeschke | |
| 4,895,331 | A | 1/1990 | Nehls | |
| 4,948,313 | A | 8/1990 | Zankovich | |
| 5,154,385 | A | 10/1992 | Lindberg et al. | |
| 5,209,619 | A | 5/1993 | Rinderer | |
| 5,245,808 | A * | 9/1993 | Grunewald | E06B 3/5427 52/204.593 |
| 5,481,839 | A | 1/1996 | Lang et al. | |
| 5,833,417 | A | 11/1998 | Sargent et al. | |
| 5,839,236 | A | 11/1998 | Frey | |
| RE36,681 | E | 5/2000 | Rinderer | |
| 6,086,300 | A | 7/2000 | Frohlich | |
| 6,105,794 | A | 8/2000 | Bauer | |
| 6,401,410 | B2 | 6/2002 | Kenny | |
| 6,484,465 | B2 | 11/2002 | Higgins | |
| 6,588,711 | B2 | 7/2003 | Onishi | |
| 6,598,361 | B2 | 7/2003 | Ting | |
| 6,712,540 | B2 | 3/2004 | Schmalzhofer et al. | |
| 6,827,320 | B2 | 12/2004 | Yeh | |
| 7,004,667 | B2 | 2/2006 | Ludwig et al. | |
| 7,234,566 | B2 | 6/2007 | Simmons | |
| 7,444,781 | B2 * | 11/2008 | Luo | E06B 3/5427 52/204.593 |
| 7,478,504 | B2 | 1/2009 | Huebner et al. | |
| 7,716,891 | B2 | 5/2010 | Radford | |
| 7,818,931 | B2 * | 10/2010 | Grunewald | E04B 2/96 52/844 |
| 8,973,316 | B2 * | 3/2015 | Safford | E04B 2/96 52/235 |
| 9,567,746 | B1 | 2/2017 | Barbulescu et al. | |
| 9,909,309 | B1 | 3/2018 | Conklin | |
| 10,934,706 | B2 * | 3/2021 | Stein | E04D 3/08 |
| 11,952,770 | B2 * | 4/2024 | Taylor | E04B 1/388 |
| 11,982,122 | B2 * | 5/2024 | Condon | E04B 2/96 |
| 2001/0004099 | A1 * | 6/2001 | Onishi | F16B 37/045 248/65 |
| 2001/0011444 | A1 * | 8/2001 | Kenny | E06B 3/5427 52/235 |
| 2002/0124514 | A1 | 9/2002 | Higgins | |
| 2003/0033764 | A1 * | 2/2003 | Ting | E04C 3/32 52/235 |
| 2003/0036314 | A1 * | 2/2003 | Schmalzhofer | F16B 7/187 439/680 |
| 2004/0025459 | A1 | 2/2004 | Huebner et al. | |
| 2004/0033103 | A1 * | 2/2004 | Ludwig | F16B 7/187 403/188 |
| 2004/0155161 | A1 * | 8/2004 | Yeh | A47B 57/565 248/220.22 |
| 2004/0221526 | A1 | 11/2004 | Rinehart et al. | |
| 2005/0034400 | A1 * | 2/2005 | Luo | E06B 3/5427 52/506.01 |
| 2005/0098392 | A1 * | 5/2005 | Simmons | B66B 7/027 187/414 |
| 2005/0284053 | A1 | 12/2005 | Grunewald et al. | |
| 2006/0123722 | A1 | 6/2006 | Stenvall et al. | |
| 2007/0094955 | A1 | 5/2007 | Safford | |
| 2007/0194191 | A1 | 8/2007 | Persson | |
| 2009/0145071 | A1 * | 6/2009 | Radford | E04F 19/061 52/506.08 |
| 2016/0222653 | A1 | 8/2016 | Niehaus et al. | |
| 2018/0283003 | A1 * | 10/2018 | Stein | E04B 2/967 |
| 2023/0038884 | A1 | 2/2023 | Condon et al. | |
| 2023/0243148 | A1 | 8/2023 | Taylor et al. | |
| 2025/0263924 | A1 * | 8/2025 | Safford | E04B 2/7435 |
| 2025/0277365 | A1 * | 9/2025 | Safford | E04B 2/90 |
| 2025/0297508 | A1 * | 9/2025 | Safford | B21C 23/142 |

FOREIGN PATENT DOCUMENTS

| | | | |
|---|---|---|---|
| EP | 0136431 | A2 | 4/1985 |
| FR | 2585391 | A1 | 1/1987 |
| GB | 2397310 | A | 7/2004 |
| KR | 20110100608 | A | 9/2011 |
| WO | 95/13439 | A1 | 5/1995 |
| WO | 00/45020 | A1 | 8/2000 |
| WO | 2002101166 | A1 | 12/2002 |
| WO | 2004083545 | A1 | 9/2004 |
| WO | 2010063297 | A1 | 6/2010 |

* cited by examiner

SYSTEM AND METHOD FOR SECTIONAL CONSTRUCTION ASSEMBLY FOR USE WITH A WOOD MULLION

RELATED APPLICATIONS

This application is a continuation in part of U.S. patent application Ser. No. 18/582,962 filed Feb. 21, 2024, entitled SYSTEM AND METHOD FOR SECTIONAL CONSTRUCTION ASSEMBLY and incorporates the disclose of the application by reference.

BACKGROUND OF THE TECHNOLOGY

A variety of systems are used in the construction of buildings, both commercial and residential. Many of these systems employ a framework, such as in the case of conventional point-supported and conventional glass wall systems. In these systems, panes of glass are attached to, and supported by horizontal and vertical mullions. The type of construction materials often require alternate methods and systems for attaching fittings that support glass panels to the building structure.

SUMMARY OF THE TECHNOLOGY

A system and method for the assembly and support of construction sections. The system may generally include a fitting that is suitably adapted for supporting a construction section or glass panel that is attached or otherwise affixed to an alternate type of structural building material. The fitting may be configured to hold and retain a construction section or glass panel once the fitting is engaged with the mullion. The mullion may include a wood or other type of wood composite material used in a variety of construction settings.

BRIEF DESCRIPTION OF THE DRAWINGS

A more complete understanding of the present technology may be derived by referring to the detailed description when considered in connection with the following illustrative figures. In the following figures, like reference numbers refer to similar elements and steps throughout the figures. For simplicity and clarity of illustration, elements in the figures are not necessarily drawn to scale.

DETAILED DESCRIPTION OF THE DRAWINGS

The present technology may be described in terms of functional block components and various processing steps. Such functional blocks may be realized by any number of components configured to perform the specified functions and achieve the various results. For example, the present technology may employ various types of mullions, fittings, hangers, fasteners, spacers, glass panels, walls, and the like, which may carry out a variety of functions. Further, the present technology may employ any number of components for a point supported construction system for supporting a glass panel.

Various representative implementations of the present technology may be applied to any system for construction. Certain representative implementations may include systems and methods tailored to a specific type of construction, such as point-supported glass wall systems.

Modern curtain walls are typically comprised of vertical and horizontal metal framing (mullions) supporting cladding (glass) panels to create a weather tight building enclosure. The framing utilizing metal mullions provides continuous contact with the edge of the cladding (glass) which limits thermal performance of the assembled façade. This standard metal façade assembly has a high carbon footprint which is detrimental to the environment. Replacing the metal framing noted with wood/timber framing and eliminating all horizontal framing materials dramatically reduces the amount of carbon dioxide released into the atmosphere related to the façade assembly that utilizes wood framing. It also provides for point-supporting the cladding panels/glass improving the thermal performance of the assembled façade reducing operating cost and reducing operational carbon dioxide emissions.

In general point-supported glass wall systems utilize fittings connected with mullions to provide support for various types of construction sections. Fittings may be attached to a mullion and the construction section or glass panel is supported by the fitting. Typically, a mullion may include any number of suitable materials, such as aluminum, steel, graphite, composite and/or the like. In one embodiment, the mullion may be fabricated from wood or timber for the reasons described above.

A wood mullion may be used as a structural or decorative element in architecture and carpentry. A wood mullion is typically a vertical member made of wood that supports the weight of the glass or other materials and can also serve aesthetic purposes.

A wood mullion can provide structural support by helping to distribute the load and prevent sagging or warping. Wood mullions can enhance the aesthetics of a building's facade. They come in various designs and profiles, allowing architects and designers to create visually appealing patterns and styles.

Figure 1A:
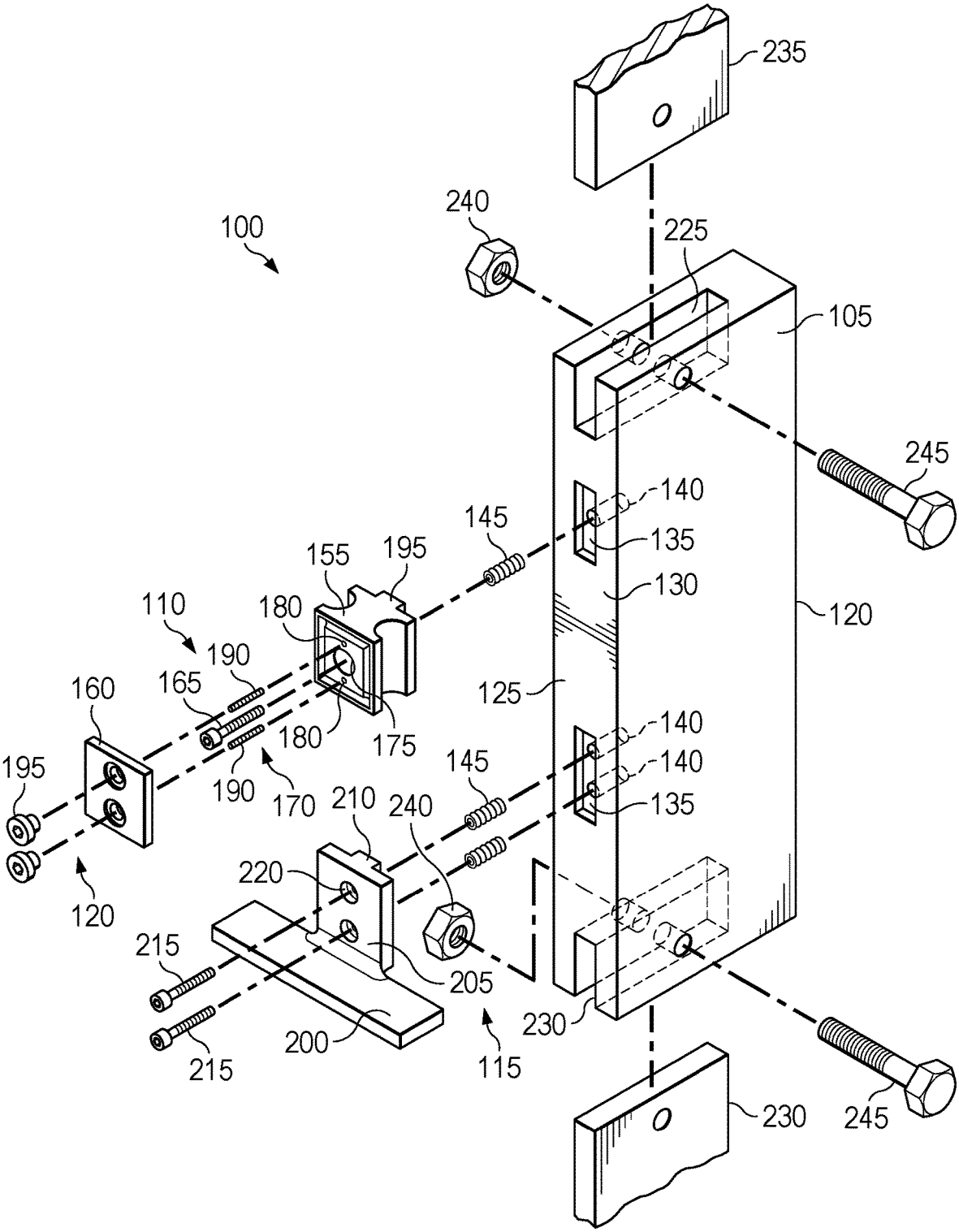
FIG. 1A representatively illustrates an isometric, exploded view of a construction assembly with a fitting and gravity fitting attached to a mullion in accordance with an exemplary embodiment of the present technology.
Figure 1B:
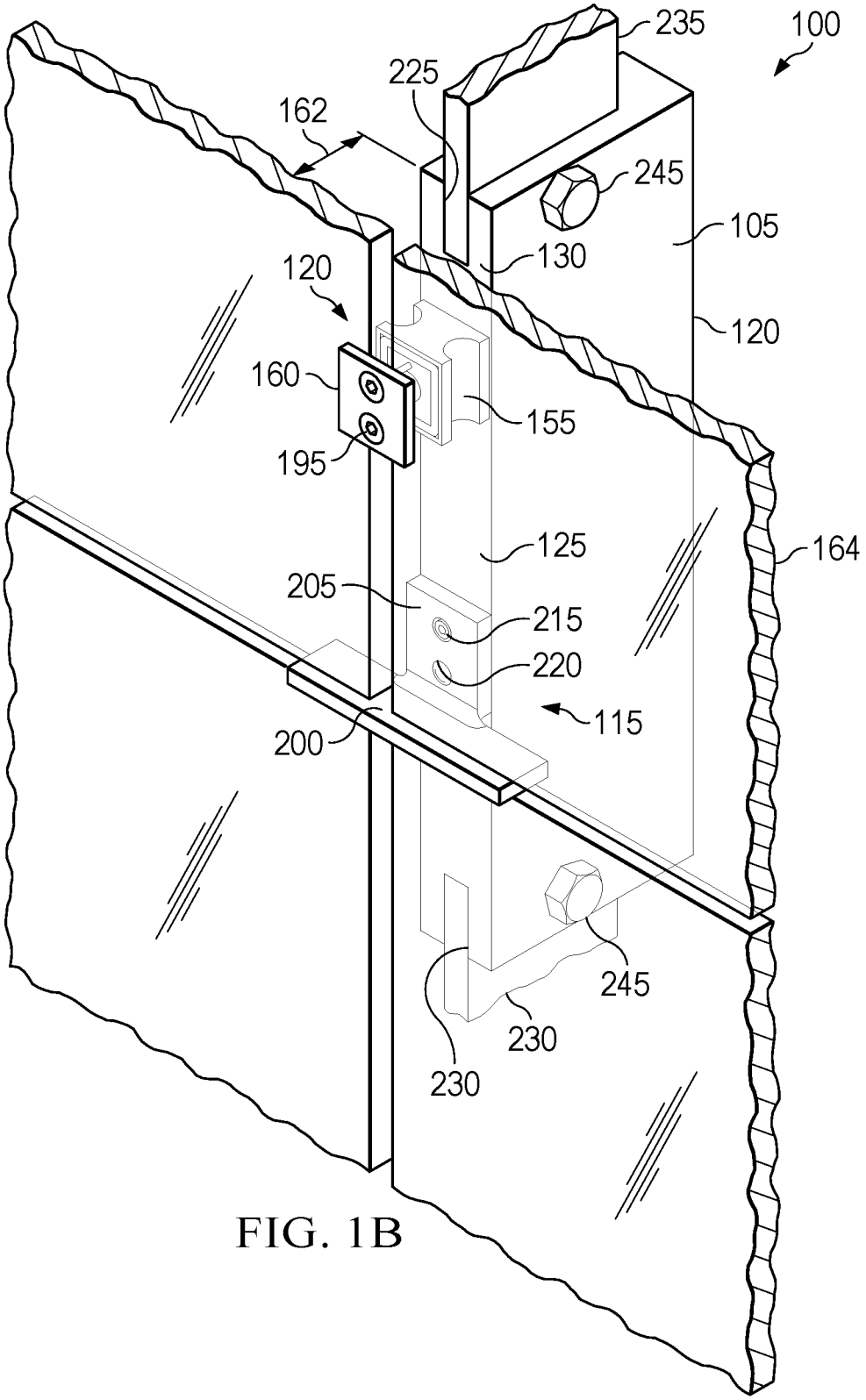
FIG. 1B representatively illustrates an isometric, assembled view of a construction assembly with a fitting and gravity fitting attached to a mullion and supporting a glass panel, in accordance with an exemplary embodiment of the present technology.
Figure 2:
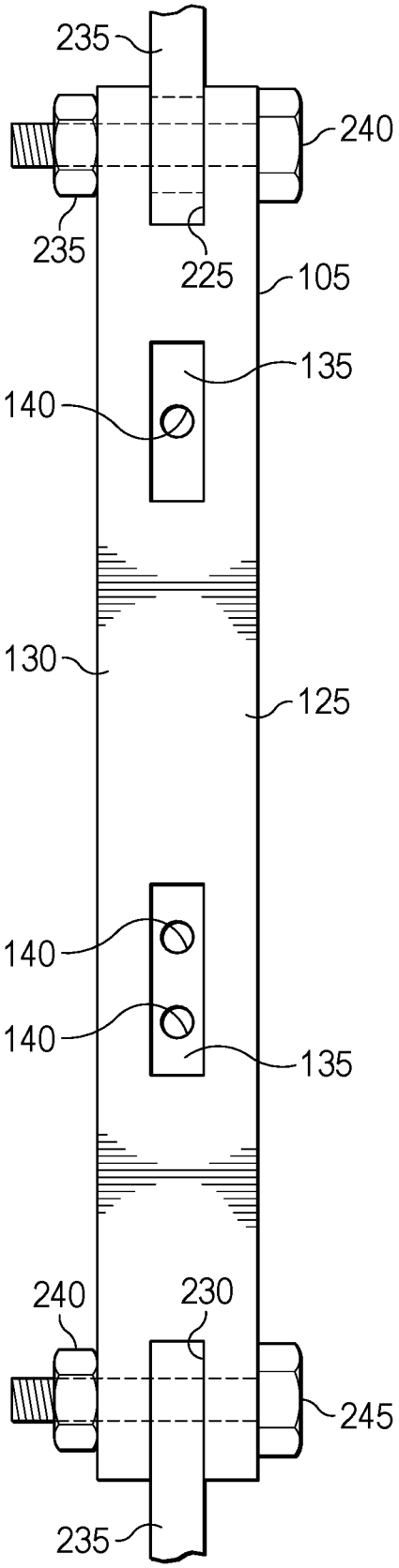
FIG. 2 representatively illustrates a front view of a mullion in accordance with an exemplary embodiment of the present technology.
Figure 3:
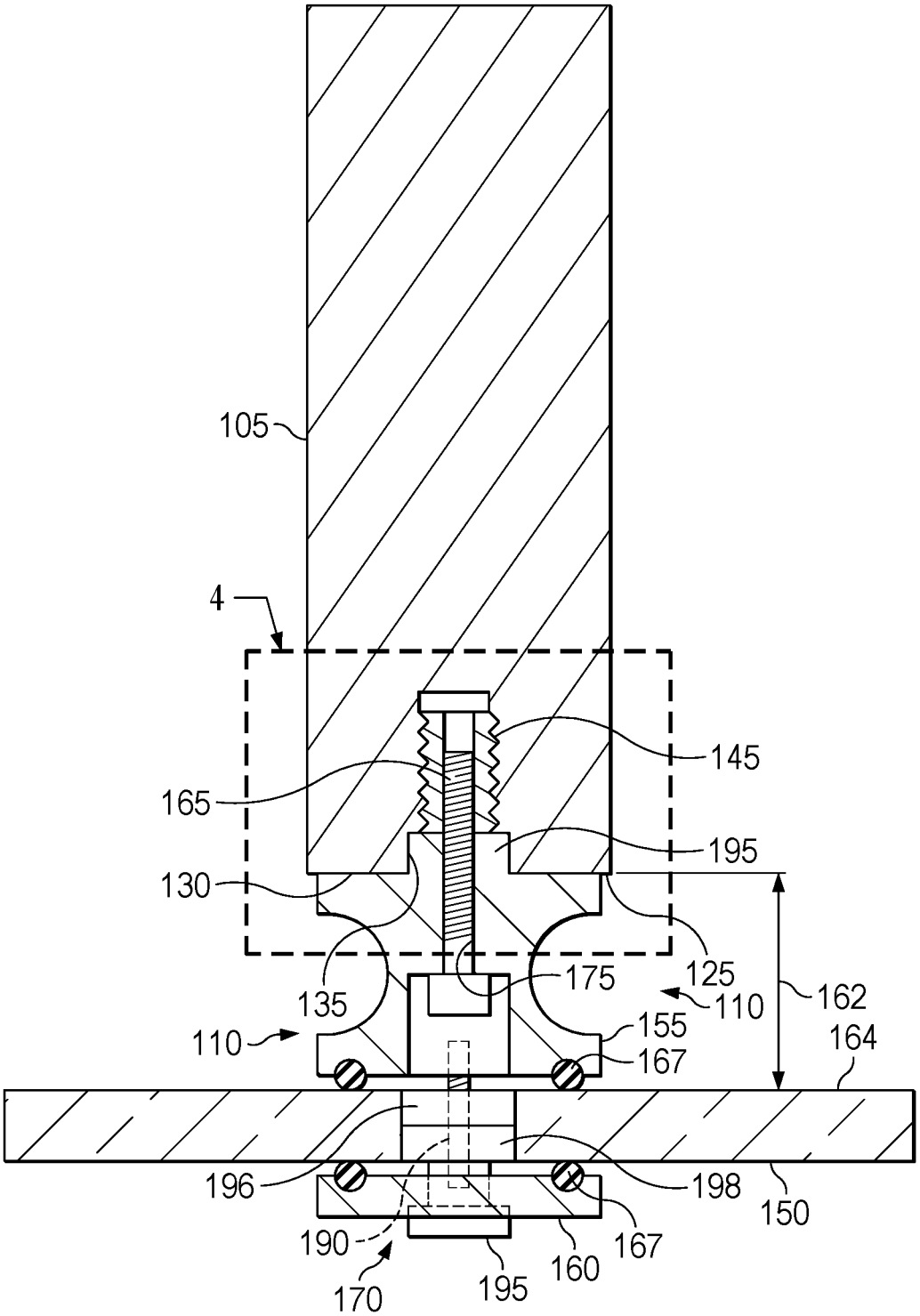
FIG. 3 representatively illustrates a top, cross-sectional view of the fitting attached to a mullion and supporting a glass panel in accordance with an exemplary embodiment of the present technology.
Figure 4:
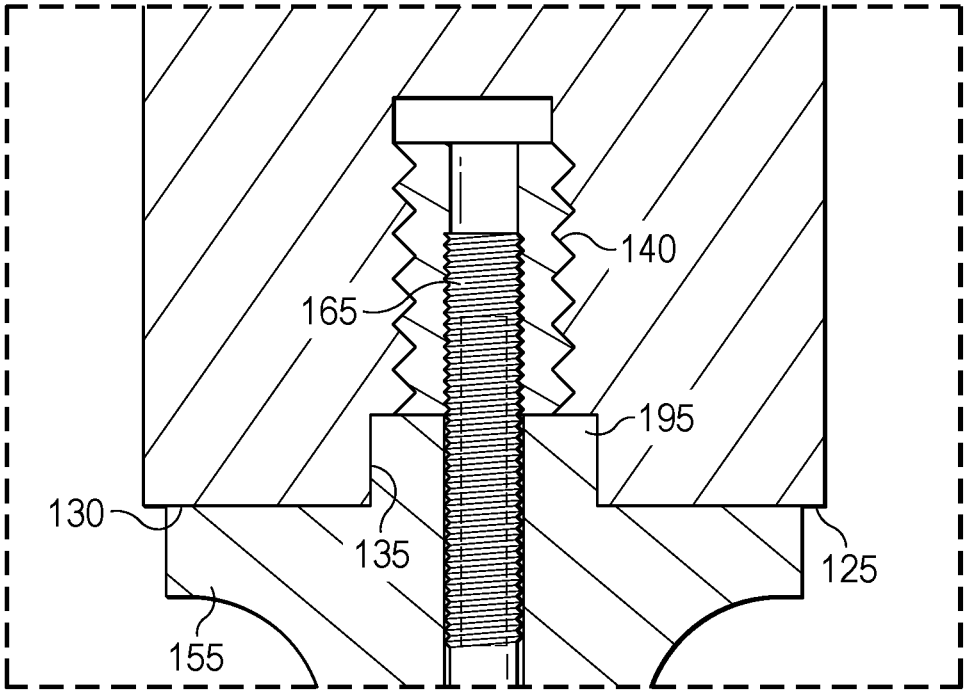
FIG. 4 representatively illustrates a detail plan view taken from FIG. 3 showing the attachment of the fitting to the mullion in accordance with an exemplary embodiment of the present technology.
Figure 5A:
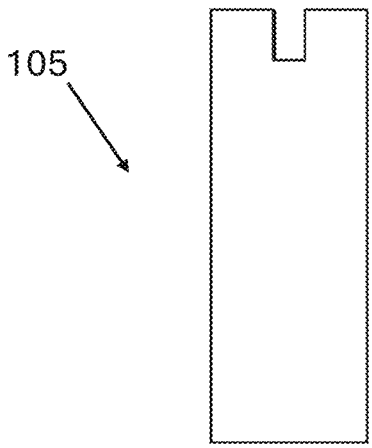
FIGS. 5A-5F representatively illustrates schematic plan views of various mullion shapes in accordance with an exemplary embodiment of the present technology.
Figure 5B:
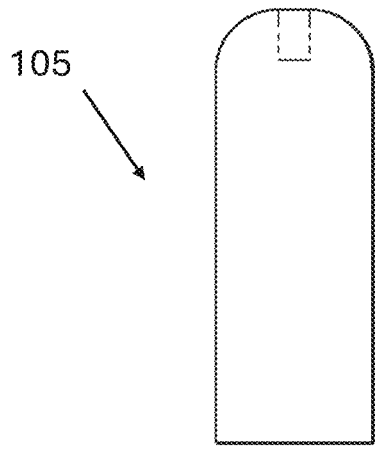
Figure 5C:
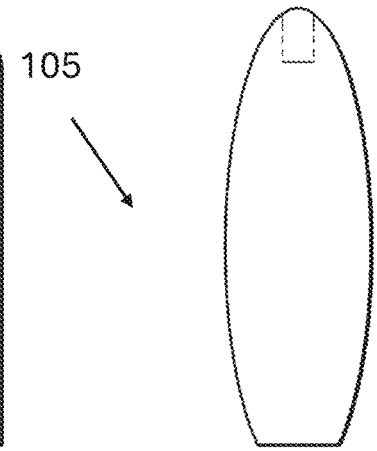
Figure 5D:
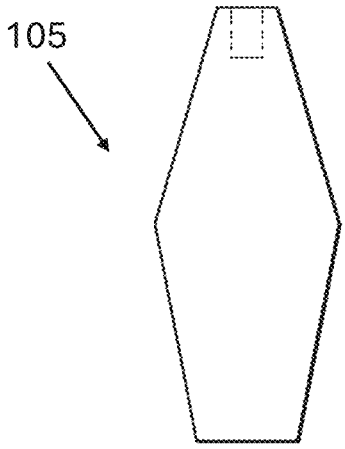
Figure 5E:
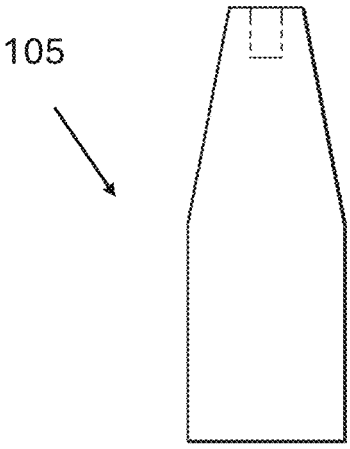
Figure 5F:
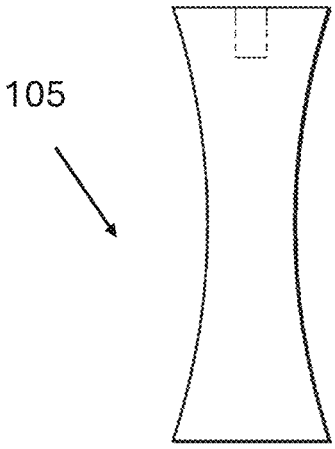

Referring now to FIGS. 1-3, a construction system 100 generally comprises a wood mullion 105, an upper fitting 110, and a gravity fitting 115. The wood mullion 105 is generally configured for engagement with the upper fitting 110 and the gravity fitting 115 and provides support for a construction section and/or glass panel held in place by the upper fitting 110 and the gravity fitting 115. The wood mullion 105 may comprise any structural or design features that may be employed to allow for the attachment of the fitting(s) 110, 115 for providing support and/or retention of construction sections. The construction sections may comprise wood, ceramic, glass, glass panels, polymer sheeting, bullet-proof glass, synthetic paneling, and the like.

The wood mullion 105 may comprise a first end 120 that may be positioned towards the interior of a structure being constructed and a second end 125 configured to be coupled to the upper fitting 110 and the gravity fitting 115.

The second end 125 of wood mullion 105 may comprise an exterior face 130 with one or more void areas or pockets 135. Each pocket 135 may comprise an aperture 140 that is drilled or otherwise created and configured to receive a portion of the upper fitting 110 and the gravity fitting 115. A metal tapped insert 145 may be received within the aperture 140. The metal tapped insert 145 may comprise internal threading configured to receive any suitable fastener.

The upper fitting 110 may be suitably configured to support any type of construction section, such as a pane of glass or glass panel 150. The upper fitting 110 may comprise an inner fitting 155, an outer fitting 160, a first fastener 165 configured to couple the upper fitting 110 to the wood mullion 105, and a second fastener 170 configured to couple the inner fitting 155 to the outer fitting 160. Once assembled the inner fitting 155 and the outer fitting 160 are configured to support at least a portion of the glass panel 150.

The orientation of the upper fitting 110 and the wood mullion 105 allows for a space or gap 162 between the exterior face 130 of the second end 125 of the wood mullion 105 and an interior surface 164 of the glass panel 150. The gap 162 may comprise a distance approximate a dimension of the inner fitting 155 between the exterior face 130 of the second end 125 of the wood mullion 105 and an interior surface 164 of the glass panel 150.

The gap 162 may improve the thermal performance of the construction system 100. The gap 162 does this by reducing the amount of contact area of the glass panel 150 and wood mullion 105 thereby reducing the thermal transfer across the construction system 100. The improved thermal performance of the construction system 100 reduces cost and lowers the operational carbon footprint of a building.

Additionally, the gap 162 allows for inspection of the upper fitting 110 and its connection to the glass panel 150 in all directions. For example, if there is a water leak the connection can be viewed from the interior and the location of the water leak may be easily identified and easily repaired to stop the water leakage. In traditional systems where the glass panel is in continuous contact with the framing system or standard wood mullion it is impossible to determine the exact location of a water leak because the actual glass joint is hidden by the framing. This improves and simplifies the building maintenance over the lifetime of a building.

Still further, the gap 162 visually separates the glass panel 150 from the metal framing (not shown), expressing the glass panels as an uninterrupted plane. This attribute visually improves the appearance of the assembled wall in the construction system 100 as compared to traditional glass wall systems, where the glass is in continuous contact with the traditional wood mullion framing.

The inner fitting 155 may comprise a first aperture 175 that is centrally located and configured to receive the first fastener 165 to couple the upper fitting 110 to the wood mullion 105. The first fastener 165 may be received within the metal tapped insert 145 to couple the upper fitting 110 to the wood mullion 105.

The inner fitting 155 may comprise additional apertures 180 located outwardly of the first aperture 175 that are configured to receive the second fastener 170 to couple the inner fitting 155 to the outer fitting 160. The outer fitting 160 may comprise additional apertures 185 that are configured to align with the additional apertures 180 in the inner fitting 155.

The second fastener 170 may comprise a stud 190 and cap nut 195 arrangement where the studs 190 are received in the additional apertures 180 in the inner fitting 155. When installed, the stud(s) 190 may be received in additional apertures 180 in the inner fitting 155 and project through an aperture(s) 185 in the outer fitting 160. The cap nut(s) 195 may then be coupled to the stud(s) 190 to assemble the fitting 110, which can then support the glass panel 150. The stud(s) 190, cap nut(s) 195, and aperture(s) may be threaded as understood by one of ordinary skill in the art. The cap(s) 195 reside within the additional apertures in the outer fitting 160 and receive the stud(s) 190 to connect the inner fitting 155 to the outer fitting 160. The upper fitting 110 may comprise at least one gasket 167 located between the inner fitting 155 and the glass panel 150 and the outer fitting 160 and the glass panel 150.

The inner fitting 155 may comprise a raised portion 195 that is received in the void area or pocket 135 of the wood mullion 105 when assembled. The raised portion 195 may snugly fit within the void area or pocket 135 when the first fastener 165 is placed within the metal tapped insert 145 to couple the upper fitting 110 to the wood mullion 105.

The gravity fitting 115 may be used in conjunction with the fitting 110 described above to support a construction section in any manner. For example, the gravity fitting 115 may be provided for vertical support of a construction section and/or glass panel 150.

The gravity fitting 115 may comprise a panel support 200 and a support arm 205. The panel support 200 engages and vertically supports the glass panel 150 and/or construction section. The support arm 205 comprises a mating surface with a raised portion 210 configured to fit within the void area or pocket 135 of the wood mullion 105 when assembled. The panel support 200 may be coupled to a lower portion of the support arm 205 and is located generally horizontal and perpendicular to the support arm 205. The support arm 205 may be oriented generally parallel to the exterior surface 130 of the mullion 105.

The support arm 205 may comprise at least one aperture 220 and the raised portion 210 configured to couple the gravity fitting 115 to the mullion 105. At least one fastener 215 may be received within the at least one aperture 220 and the metal tapped insert 145 to couple the gravity fitting 115 to the wood mullion 105. The raised portion 210 may snugly fit within the void area or pocket 135 when the at least one fastener 215 is placed within the metal tapped insert 145 to couple the gravity fitting 115 to the wood mullion 105.

The structure of the wood mullion 105 allows it to support the weight of the construction section or glass panel 150 held by the upper fitting 110 and the gravity fitting 115. Additionally, the wood mullion 105 may permit translational or rotational motion in response to environmental effects, such as wind, rain and/or thermal expansion or contraction.

The wood mullion 105 may connect with any suitable structures, systems and devices in any suitable manner to achieve any particular purpose. The wood mullion 105 may be configured for attachment to a surface such as a floor, wall and/or the like. The wood mullion 105 may comprise any suitable shape, such as, the shapes including but not limited to those shown in FIGS. 5A-5F. The wood mullion 105 may be attached to any suitable surface in any suitable manner, and may be configured to support any structure, system, device or architectural element in any suitable manner. For example, the structure of the wood mullion 105 may comprise upper and lower cutouts 225, 230 that are configured to couple the mullion 105 to a building structure 235. The cutouts 225, 230 can be shaped in any manner that will allow the wood mullion 105 to be coupled to a suitable building structure. In one embodiment a plate 235 may be inserted within the cutouts 225, 230 and fastened thereto by a nut 240 and bolt 245 configuration.

In a construction system according to various aspects of the present technology, mullions may be attached to the structure of a building to provide a framework for supporting construction sections. Suitably configured fittings may be attached to the mullions to provide point-supported or continuously supported retention of construction sections. Construction systems in accordance with various exemplary embodiments of the present technology may be used to build any type of structure, such as a point-supported glass wall, for example. The construction system may also be used to achieve various aesthetic benefits. For example, the panes of glass used to form a glass wall will generally be displaced away from the mullions, making it more difficult to see the mullions from an exteriorly disposed vantage point. Additionally, construction systems in accordance with the present technology may be used to achieve any structural benefit, whether now known or hereafter described in the art, such as the ability to construct a multi-story point-supported glass wall system using substantially vertically aligned mullions without the need for horizontally-aligned mullions.

Constructs (i.e., construction designs) that may be realized via implementation of various embodiments of the present technology shall be understood to comprise anything that may be at least partially assembled from at least one or more component parts, such as, for example: a window; a wall; a partition; a frame; a panel; a covering; a dome; a door; a display case; a display wall; a display frame; a cubicle; a presentation display; a booth; an enclosure; a temporary habitat; a mobile home; a video device array; various architectural construction elements; and/or the like.

A 'construction section' shall be understood to comprise any component part of a construct surface, such as, for example, a pane of glass, a panel of wood, a sheet of drywall, a graphite board, Plexiglas, Lucite, a video device element, etc. Furthermore, a construction section may comprise any two-dimensional (e.g., substantially planar) or three-dimensional (e.g., polyhedral, spherical, hemispherical, elliptical, parabolic, etc.) geometry and/or any combination thereof.

In the foregoing description, the technology has been described with reference to specific exemplary embodiments. Various modifications and changes may be made, however, without departing from the scope of the present technology as set forth. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any appropriate order and are not limited to the explicit order presented in the specific examples. Additionally, the components and/or elements recited in any system embodiment may be combined in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

As used herein, the terms "comprises," "comprising," or any variation thereof, are intended to reference a non-exclusive inclusion, such that a process, method, article, composition or apparatus that comprises a list of elements does not include only those elements recited but may also include other elements not expressly listed or inherent to such process, method, article, composition or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same. Any terms of degree such as "generally," "substantially," "about," and "approximate" as used herein mean a reasonable amount of deviation of the modified term such that the end result is not significantly changed. For example, these terms can be construed as including a deviation of at least ±5% of the modified term if this deviation would not negate the meaning of the word it modifies.

The present technology has been described above with reference to an exemplary embodiment. However, changes and modifications may be made to the exemplary embodiment without departing from the scope of the present technology. These and other changes or modifications are intended to be included within the scope of the present technology.

The invention claimed is:

1. A construction section for supporting a glass panel and configured to be coupled to a building structure, comprising:
- a solid wood mullion comprising:
  - an elongate body having an exterior face, an upper end, and a lower end;
  - a pair of cutouts located in the upper and lower ends configured to receive at least a portion of the building structure;
  - an upper pocket having an upper void area recessed within the elongate body adjacent the exterior face; and
  - a lower pocket having a lower void area recessed within the elongate body adjacent the exterior face;
- an upper fitting coupled within the upper pocket and configured to support at least a first portion of the glass panel, the upper fitting comprising:
  - an inner fitting;
  - an outer fitting;
  - a first fastener configured to couple the inner fitting to the upper pocket; and
  - a second fastener configured to couple the inner fitting to the outer fitting;
- a gravity fitting coupled within the lower pocket and configured to support at least a second portion of the glass panel, the gravity fitting comprising:
  - a panel support extending substantially horizontally and perpendicular to the exterior face of the mullion, the panel support configured to vertically support the glass panel;

a support arm coupled to the panel support and extending substantially vertically therefrom; and a third fastener configured to couple the gravity fitting to the lower pocket.

2. The construction section of claim 1, wherein an interior surface of the glass panel is spaced apart from the exterior face of the wood mullion by a gap.

3. The construction section of claim 1, wherein an interior surface of the glass panel is spaced apart from the exterior face of the wood mullion by the inner fitting.

4. The construction section of claim 1, wherein the first, second, and third fasteners comprise a stud and cap nut.

5. The construction section of claim 1, wherein the upper and lower pockets each contain an aperture that receives an insert configured to couple the first and third fasteners.

6. The construction section of claim 5, wherein the insert is a metal tapped insert having internal threads that receive the first and third fasteners.

7. The construction section of claim 1, wherein the panel support vertically supports the glass panel.

8. The construction section of claim 7, wherein the panel support is coupled to a lower portion of the support arm and is located substantially horizontal and perpendicular to the support arm.

9. The construction section of claim 8, wherein the support arm is oriented substantially parallel to the exterior face of the mullion.

10. The construction section of claim 9, wherein the support arm comprises a mating surface with a raised portion configured to fit within the void area of the lower pocket.

11. A construction system configured to be coupled to a building structure, comprising:

a glass panel;

a solid wood mullion comprising:

an elongate body having an exterior face, an upper end, and a lower end;

a pair of cutouts located in the upper and lower ends configured to receive at least a portion of the building structure;

an upper pocket having an upper void area recessed within the elongate body adjacent the exterior face; and a lower pocket having a lower void area recessed within the elongate body adjacent the exterior face;

an upper fitting coupled within the upper pocket and configured to support at least a first portion of the glass panel, the upper fitting comprising:

an inner fitting;

an outer fitting;

a first fastener configured to couple the inner fitting to the upper pocket; and a second fastener configured to couple the inner fitting to the outer fitting;

a gravity fitting coupled within the lower pocket and configured to support at least a second portion of the glass panel, the gravity fitting comprising:

a panel support extending substantially horizontally and perpendicular to the exterior face of the mullion, the panel support configured to vertically support the glass panel;

a support arm coupled to the panel support and extending substantially vertically therefrom; and a third fastener configured to couple the gravity fitting to the lower pocket.

12. The construction system of claim 11, wherein an interior surface of the glass panel is spaced apart from the exterior face of the wood mullion by a gap.

13. The construction system of claim 11, wherein an interior surface of the glass panel is spaced apart from the exterior face of the wood mullion by the inner fitting.

14. The construction system of claim 11, wherein the first, second, and third fasteners comprise a stud and cap nut.

15. The construction system of claim 11, wherein the upper and lower pockets each contain an aperture that receives an insert configured to couple the first and third fasteners.

16. The construction system of claim 15, wherein the insert is a metal tapped insert having internal threads that receive the first and third fasteners.

17. The construction system of claim 11, wherein the panel support vertically supports the glass panel.

18. The construction system of claim 17, wherein the panel support is coupled to a lower portion of the support arm and is located substantially horizontal and perpendicular to the support arm.

19. The construction system of claim 18, wherein the support arm is oriented substantially parallel to the exterior face of the mullion.

20. The construction system of claim 19, wherein the support arm comprises a mating surface with a raised portion configured to fit within the void area of the lower pocket.

* * * * *